US006453650B1

(12) United States Patent
Laguna

(10) Patent No.: US 6,453,650 B1
(45) Date of Patent: Sep. 24, 2002

(54) MACHINE FOR THE FABRICATION OF CONTAINERS WITH CONSUMABLE CONTENT

(76) Inventor: Vicente Gomez Laguna, Calle General Ramos Serrano, 12, 4°, E-38004, Santa Cruz de Tenerife (ES)

( * ) Notice: Subject to any disclaimer, the term of this patent is extended or adjusted under 35 U.S.C. 154(b) by 0 days.

(21) Appl. No.: 09/581,571

(22) PCT Filed: Oct. 22, 1999

(86) PCT No.: PCT/ES99/00341

§ 371 (c)(1),
(2), (4) Date: Jun. 12, 2000

(87) PCT Pub. No.: WO00/24635

PCT Pub. Date: May 4, 2000

(30) Foreign Application Priority Data

Oct. 23, 1998 (ES) ..... 9802235

(51) Int. Cl.[7] ..... B65B 47/00

(52) U.S. Cl. ..... 53/559; 53/442; 53/505; 53/506; 53/558

(58) Field of Search ..... 53/505, 558, 559, 53/506, 427, 441, 442, 456

(56) References Cited

U.S. PATENT DOCUMENTS

| | | | | |
|---|---|---|---|---|
| 3,659,993 A | | 5/1972 | Brown, Jr. | |
| 3,808,772 A | | 5/1974 | Turtschan | |
| 3,837,782 A | | 9/1974 | Meissner et al. | |
| 3,918,237 A | | 11/1975 | Stark et al. | |
| 4,094,127 A | * | 6/1978 | Romagnoli | 53/141 |
| 4,684,025 A | * | 8/1987 | Copland et al. | 206/484 |
| 5,001,889 A | * | 3/1991 | Mueller | 141/314 |
| 5,081,819 A | * | 1/1992 | Cloud | 425/373 |
| 5,187,921 A | * | 2/1993 | Wilson et al. | 141/1 |
| 5,492,465 A | * | 2/1996 | Matuzawa et al. | 188/325 |
| 5,799,468 A | * | 9/1998 | Eck et al. | 53/237 |

* cited by examiner

*Primary Examiner*—Rinaldi I. Rada
*Assistant Examiner*—Christopher Harmon
(74) *Attorney, Agent, or Firm*—Harrison & Egbert

(57) ABSTRACT

Machine for manufacturing consumable goods containers, including a structure in which four modules are located, two supply modules (1) and (2), one dosage module (3) and the other a cutting module (4). It includes thermo-plastic material reels (5) and (6) of a variable band width, provided with winding means (7) and (21) and heating means (8) and (22), as well as shaping matrixes (9) and (23) that function when heated under pressure and result in concave shapes on the bands applicable as halves of the containers to be obtained.

4 Claims, 1 Drawing Sheet

MACHINE FOR THE FABRICATION OF CONTAINERS WITH CONSUMABLE CONTENT

BACKGROUND OF THE INVENTION

1. Field of the Invention

Present invention relates to a machine for manufacturing consumable goods containers, the obvious aim of which lies in allowing the manufacture of containers in series which are subsequently filled with consumable goods, such as infusions, medicines, etc. and then the container previously filled with the consumable goods is closed.

This invention is applied in the industry dedicated to the manufacture of containers, specifically the industry dedicated to the manufacture of machines for manufacturing containers that simultaneously fill the container being manufactured and then make it watertight.

2. Description of the Related Art

There are a number of containers intended to be used as consumable goods containers, as well as applicable machines to manufacture them.

However, there is no invention that, although it has the same objective, has a much quicker manufacturing process, is able to generate numerous containers simultaneously which, at the same time, can have different shapes and is able to manufacture the containers in accordance with the inclusion of the pertinent molding and cutting matrixes that form a part of the machine itself.

SUMMARY OF THE INVENTION

The machine for manufacturing consumable goods containers proposed by the present invention has a structural unit which unites in one invention only the processes of filling the container with consumable goods of a container previously shaped, as well as the closing and stamping of the previously manufactured and filled container, thus carrying out a continuous and synchronized manufacturing process.

More specifically, the machine for manufacturing consumable goods containers comprise a frame, chassis or structure in which four modules are housed. Two of these modules are intended for supply and providing the raw materials for shaping the container in two halves and providing the appropriate means for creating the shape with heat and pressure. Another module is a dosage module containing the consumable goods and the means for its dosage and filling in one of the two halves of the manufactured container. Lastly, there is a cutting module with suitable means for carrying out the sealing by means of welding the two halves, as well as for final stamping of the container.

The raw materials used for shaping supplied by the two previously mentioned supply modules may be thermoplastic in the form of reels with a variable band width.

BRIEF DESCRIPTION OF THE SEVERAL VIEWS

In order to complement this description and to help with a better understanding of the characteristics of the invention, attached is one sheet of drawings in which the following has been represented in an illustrative and non-limiting way.

Figure 1:
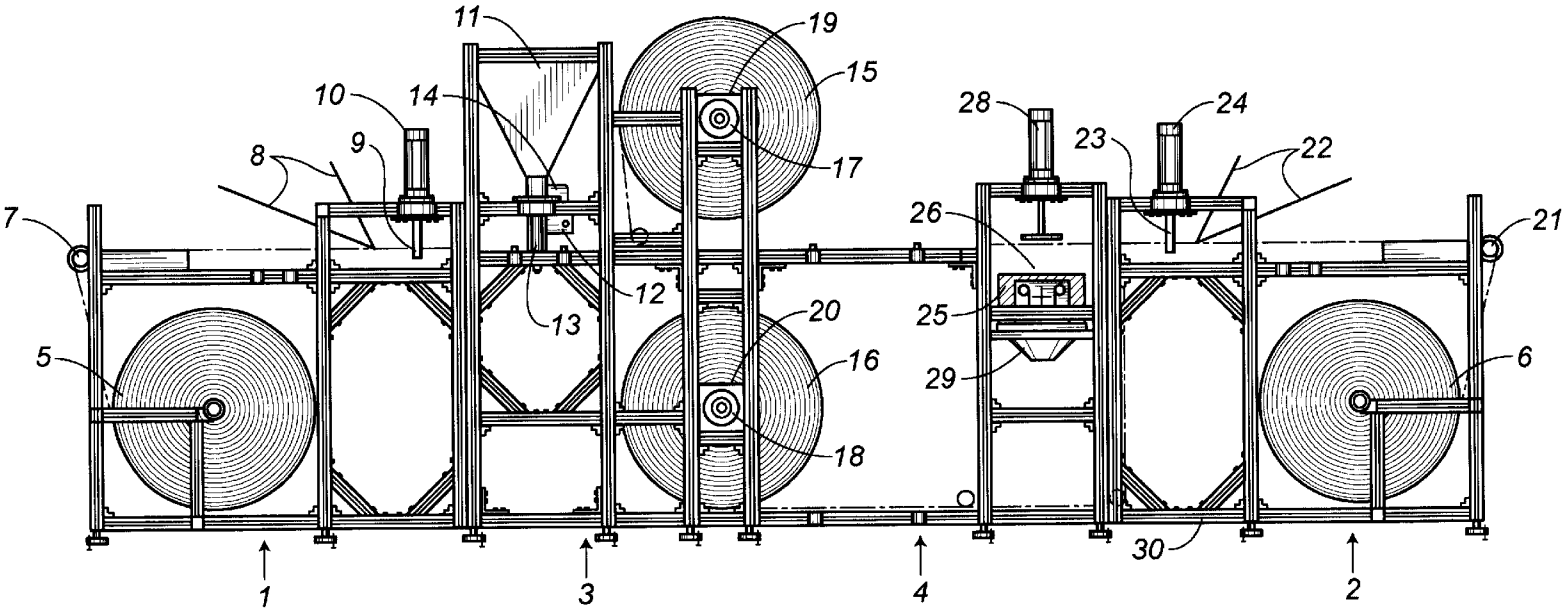

FIG. 1 corresponds to a side elevation view of the invention, regarding a machine for manufacturing consumable goods containers.

Figure 2:
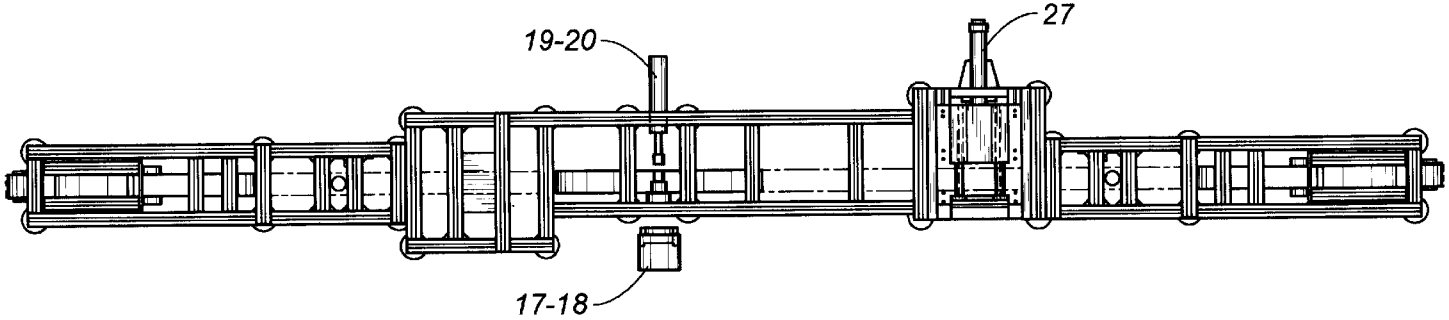

FIG. 2 shows a floor view of the object represented in FIG. 1.

DETAILED DESCRIPTION

In view of the above figure it can be seen how the machine for manufacturing consumable goods containers is made up of a train of linked modules, in each of which a part of the manufacturing process is made. The modules are integrated in a structure or metallic frame formed or obtained by aluminum or similar profiles, including four modules (1), (2), (3) and (4), two of which (1) and (2) are supply modules. Module (3) is for dosage application and the fourth module (4) is intended to be used as a cutting module.

The supply modules (1) and (2) are the same and are located at the opposite ends of the machine. They are called supply modules as they are intended to contain identical plastic material reels (5) and (6) applicable as raw material for manufacturing the body of the containers. In other words, they contain a plastic sheet intended to shape the containers based on the use of heat. The mentioned reels containing the sheets have a variable band width and are turned by means of two axes, including a counterweight for braking.

A plastic material reel (5) is located in the supply module (1) the free end of which is connected to a conventional type pneumatic feeder (7) that slowly coils it and that, at the same time, has two components, one mobile that marks the feed which can be regulated and another fixed that maintains the band secure in a precise way.

Next are located some nozzles (8) that expel hot air in order to raise the temperature of the band until reaching a temperature between 90° C. and 100° C. This step is previous to the shaping of the cavities to be made by the containers.

The nozzles (8) are directed towards the center of a shaping matrix (9) provided with two homologous male and female components, because this is the zone where the suitable temperature for shaping under pressure is to be reached. It should be indicated that by means of operating a pneumatic cylinder (10) acting on the tongue and groove matrix (9), the cavity engraved on the previously heated band is finally shaped, resulting in a certain concave form in accordance with the design of the container to be manufactured.

In this operation the heat and pressure of a matrix are combined and centering drills are also obtained.

Inside the supply module (1) there are cooling means of the matrix (9) so that the plastic band leaves the module heat-free. It is driven by means of rollers of the feeder (7) itself. A hopper (11) has been provided in the dosage module (3) inside which the consumable goods are placed. This hopper (11) is suspended by means of springs and has a vibrating movement in collaboration with a valve.

The plastic material band with the pre-engraved cavities is located on the lower part and the hopper having a commercial origin is found next to a volumetric dosimeter (12) which it supplies. It comprises a plate having an alternating swing that permits the right amount of the product to pass through. This falls inside other hoppers (13) with a smaller volume and variable number depending on the cavities engraved on the band, resulting in the simultaneous filling of said cavities.

The invention has an optic reader (14) intended to record the centering drills made on the band by the shaping matrix (9) and which, in turn, operate the dosimeter (3), specifically the hopper (11), at the right moment to carry out correct loading of the cavities.

In the dosimeter module (3) there are reels (15) and (16) that pick up the surplus of the plastic material coming from the reels (5) and (6) of the supply modules (1) and (2) for subsequent recycling. This is possible thanks to two pneumatic winding machines (17) and (18) that, due to the low turning couple developed, maintain the bands taut.

Extraction from the recycling reels (15) and (16) mentioned above, included in the dosimeter module, is made by removing both pneumatic cylinders (19) and (20) that leave the reels loose so that the operator can remove them.

There is a reel (6) with identical characteristics in the supply module (2) located at the end of the machine diametrically opposite the first one (1), which is associated with another pneumatic feeder (21) provided with two components, one fixed and the other mobile, that at the same time move and secure the band.

The invention has some heating nozzles (22) to facilitate shaping the raw material. This is caused when another shaping matrix (23) similar to the one located in the previous supply module (1) enters into action, driven likewise by a pneumatic cylinder (24). One or various cavities are generated in the hot band, which will later be the cavities that shape the other half of the container to be shaped and have centering drills.

In the so-called cutting module (4), during the last stage of the manufacturing process, the two bands coming from their respective supply modules (1) and (2) are found and, therefore, pertaining to the corresponding reels (5) and (6), already duly shaped as verified above and one of them, with the engraved cavities, filled with the consumable goods.

The invention has suitable means to permit alignment of of both bands and their physical contact and then carry out their centering by means of guide dies or centering elements that coincide exactly with the mentioned drills made in the bands.

In the fourth cutting module (4) there is a tool or welding matrix (25) operated by ultrasound, including a cutting matrix (26) or punch, with the parts (25) and (26) integrated with a pneumatic cylinder (27) that moves one or the other in the horizontal direction with the help of springs, in order to invert the movement, based on the operation to be carried out.

The tools or matrixes (25) and (26) are operated with the help of the pneumatic cylinder (28) located vertically. This transmits a strong pressure to the plastic material bands which, as has been described above, are located centrally at this point and in close physical contact.

Two consecutive operations are made in the cutting module (4). One comprises ultrasound welding of the two halves of the container resulting from the respective supply modules as, firstly, the welding matrix or tool (25) is operated by means of the vertically placed pneumatic cylinder (28) and stamping of the part when, after operation of the two pneumatic cylinders (27) and (28) has ceased, the springs move the matrixes inversely and the cutting module (26) is placed in a suitable position.

The vertically placed pneumatic cylinder (28) applies pressure to the die and the resulting part falls through a ramp (29) into a container.

The whole set is integrally supported in a structure (30), preferably metallic, manufactured in aluminum profiles.

I claim:

1. A machine for manufacturing containers having consumer goods therein comprising:

a first supply module having a reel of thermoplastic material therein;

a first conduction means affixed to said first supply module, said first conduction means for unreeling the thermoplastic material therefrom and for moving the thermoplastic material therefrom;

a first heating means positioned on said first supply module, said first heating means for elevating a temperature of the thermoplastic material as moved by said first conduction means;

a first shaping means positioned on said first supply module, said first shaping means for shaping the heated thermoplastic material under pressure so as to form generally concave bands into the heated thermoplastic material;

a dosage module connected to an end of said first supply module at an end opposite said reel, said dosage module containing a supply of the consumer goods therein;

a first discharge means connected to a bottom of said dosage module above the shaped thermoplastic material, said first discharge means for depositing the consumer goods from said dosage module into the generally concave bands;

a second supply module having a reel of thermoplastic material therein, said second supply module positioned on an opposite side of said dosage module from said first supply module, said reel of thermoplastic material of said second supply module being at a similar level as said reel of thermoplastic material of said first supply module;

a second conduction means affixed to said second supply module, said second conduction means for unreeling and moving the thermoplastic material therefrom;

a second heating means positioned on said second supply module, said second heating means for elevating a temperature of the thermoplastic material as moved by said second conduction means;

a second shaping means positioned on said second supply module, said second shaping means positioned on said second supply module, said second shaping means for shaping the heated thermoplastic material under pressure as moved by said second conduction means so as to form a generally concave band thereinto;

a cutting module positioned between said dosage module and said second supply module;

a centering and superpositioning means affixed to said cutting module, said centering and superpositioning means for centering and superpositioning the generally concave bands such that the concavities of the concave banks have openings facing each other;

a welding means positioned on said cutting module, said welding means for welding the sheets of thermoplastic material together around a periphery of the superimposed concave bands;

a cutting means positioned on said cutting module, said cutting means for cutting the welded sheets of thermoplastic material around said periphery of the superimposed concave bands;

a second discharge means affixed to said cutting means, said second discharge means for discharging the cut superimposed concave bands with the consumer goods contained therein into a container positioned below said welding means and said cutting means; and a frame having said first and second supply modules and said dosage module and said cutting module affixed thereto.

2. The machine of claim 1, the reels of thermoplastic material having a variable band width.

3. The machine of claim 1, said dosage module having a hopper positioned therein, said hopper containing the consumer goods, the machine further comprising:

a vibration means cooperative with said hopper, said vibration means for vibrating said hopper;

a dosimeter means connected to a discharge outlet of said hopper, said dosimeter means having an optical reader, said dosimeter means for receiving a signal from the thermoplastic material from said reel of said first supply module, said dosimeter means for opening said discharge outlet of said hopper so as to deposit the consumer goods into the concavity of the concave bands in the thermoplastic material from said reel of said first supply module.

4. The machine of claim 3, said hopper comprising a plurality of hoppers of decreasing sizes extending toward the concave band.

* * * * *